US006614023B2

(12) United States Patent
Focke et al.

(10) Patent No.: US 6,614,023 B2
(45) Date of Patent: Sep. 2, 2003

(54) PROCESS AND APPARATUS FOR PROVIDING CODINGS ON (CIGARETTE) PACKS

(75) Inventors: Heinz Focke, Verden (DE); Martin Stiller, Verden (DE); Jens Schmidt, Grasberg (DE); Ralph Sgodzai, Ritterhude (DE)

(73) Assignee: Focke & Co. (GmbH & Co.), Verden (DE)

( * ) Notice: Subject to any disclaimer, the term of this patent is extended or adjusted under 35 U.S.C. 154(b) by 106 days.

(21) Appl. No.: 09/768,140

(22) Filed: Jan. 24, 2001

(65) Prior Publication Data

US 2001/0032932 A1 Oct. 25, 2001

(30) Foreign Application Priority Data

Jan. 31, 2000 (DE) ..... 100 04 022

(51) Int. Cl.[7] ..... G03C 5/16; G01N 21/00

(52) U.S. Cl. ..... 250/319; 250/318; 356/237.4; 356/237.5; 356/240.1

(58) Field of Search ..... 250/319, 318; 356/220.1, 237.4, 237.5; 53/234, 246

(56) References Cited

U.S. PATENT DOCUMENTS

| | | | | |
|---|---|---|---|---|
| 3,440,392 A | | 4/1969 | Erlandson et al. | |
| 3,735,552 A | * | 5/1973 | Derderian | 53/505 |
| 3,738,260 A | | 6/1973 | Gottscho | |
| 3,922,837 A | | 12/1975 | David | |
| 4,110,595 A | | 8/1978 | Brambilla et al. | |
| 4,330,976 A | * | 5/1982 | Blackall et al. | 53/151 |
| 4,636,186 A | | 1/1987 | Focke et al. | |
| 4,638,144 A | | 1/1987 | Latta, Jr. | |
| 4,738,073 A | * | 4/1988 | Mattei et al. | 53/51 |
| 4,942,715 A | | 7/1990 | Focke | |
| 5,357,077 A | | 10/1994 | Tsuruta | |
| 5,612,525 A | | 3/1997 | Apter et al. | |
| 5,946,884 A | * | 9/1999 | Nordstrom et al. | 53/225 |
| 5,987,847 A | * | 11/1999 | Nordstrom et al. | 53/234 |
| 6,031,202 A | | 2/2000 | Arakawa et al. | |
| 6,098,533 A | | 8/2000 | Polloni et al. | |

FOREIGN PATENT DOCUMENTS

| | | |
|---|---|---|
| DE | 42 09 454 | 9/1993 |
| DE | 197 42 536 | 4/1999 |
| DE | 199 24 449 | 12/1999 |
| EP | 456 261 | 11/1991 |
| EP | 0 941 775 A2 | 9/1999 |
| FR | 2 098 792 | 3/1972 |
| GB | 2 337 974 | 12/1999 |
| WO | WO 94/05459 | 3/1994 |
| WO | WO 99/21722 | 5/1999 |

* cited by examiner

*Primary Examiner*—John R. Lee
*Assistant Examiner*—Bernard Souw
(74) *Attorney, Agent, or Firm*—Sughrue Mion, PLLC

(57) ABSTRACT

For coding (cigarette) packs (10) in the region of a conveyor, in particular in the region of a (drying) turret (34). A region of an outer pack surface, in particular of a side surface (14), is exposed during the coding. For this purpose, it is possible for the conveying elements of the conveyor to be arranged or designed correspondingly and/or for the walls (42) of the conveyor pockets (33) to be dimensioned correspondingly. Alternatively, the packs (10) are removed from the conveyor, or moved out of the pockets (33), into the region of action of a laser coder (19).

28 Claims, 9 Drawing Sheets

19
56
55
42
59
54
19
54
33
41
15
15
57
43
58
13
10
37
13
43
41
42
33
43
44
34
10
44
39
38
40

49
50
52
33
42
53
13
51
10
14
14
14
48
10
54
44

50
10
14
15
54
49
13
51
34
33
44
42
52

PROCESS AND APPARATUS FOR PROVIDING CODINGS ON (CIGARETTE) PACKS

BACKGROUND OF THE INVENTION

The invention relates to a process for providing markings or printing on free outer surfaces of packs by means of a printing unit, in particular for providing codings on (cuboidal) cigarette packs by means of a laser coder, the printing unit/the laser coder being positioned in a stationary manner alongside an endless conveyor for the packs. The invention also relates to an apparatus for carrying out the process.

The provision of informative printing and/or codings is gaining increasing importance, in particular for cigarette packs. It is important to integrate the process of printing into the working process of the packaging machine. In this respect, laser printers or laser coders have provided the best results so far. The printing- or code-bearing surface on the outside of the cigarette pack is provided with a coating which is partially removed by the laser coder.

SUMMARY OF THE INVENTION

The object of the invention is for the provision of markings or codings on (cigarette) packs to be rendered such that the process and apparatus are integrated in the operating process of the packaging machine and do not require any separate measures.

In order to achieve this object, the process according to the invention is characterized in that the packs are moved past by way of an at least partially free outer surface of the pack, said outer surface being directed towards the printing unit/laser coder and not covered by the endless conveyor, and in that the printing or coding is provided on the free outer surface, or on the free part of the outer surface, of the pack during the conveying movement or during a temporary standstill of the pack.

According to the invention, the packs are transported such that one side of the pack not gripped or covered by the conveying elements is facing the printer or laser coder. Particularly advantageous is the transport of cigarette packs in pack groups, with the pack surfaces in the region of a station facing the laser coder, which simultaneously provides printing or coding to a plurality of packs in the region of the surface concerned. Here measures are provided for the exact positioning of the packs and surfaces to be printed. The conveyor for the cigarette pack can be a drying turret with pockets for accommodating a group of packs each, whose end surfaces are directed radially outward and exposed for printing.

As an alternative, packs can be transported by belt conveyors, with printing being provided to pack surfaces which lie transverse to the pack surfaces gripped by the belt conveyors.

BRIEF DESCRIPTION OF THE DRAWING

Further details of the invention are explained more specifically in the following, with reference being made to exemplary embodiments of the apparatus, whose figures show.

DETAILED DESCRIPTION OF THE INVENTION

Figure 1:
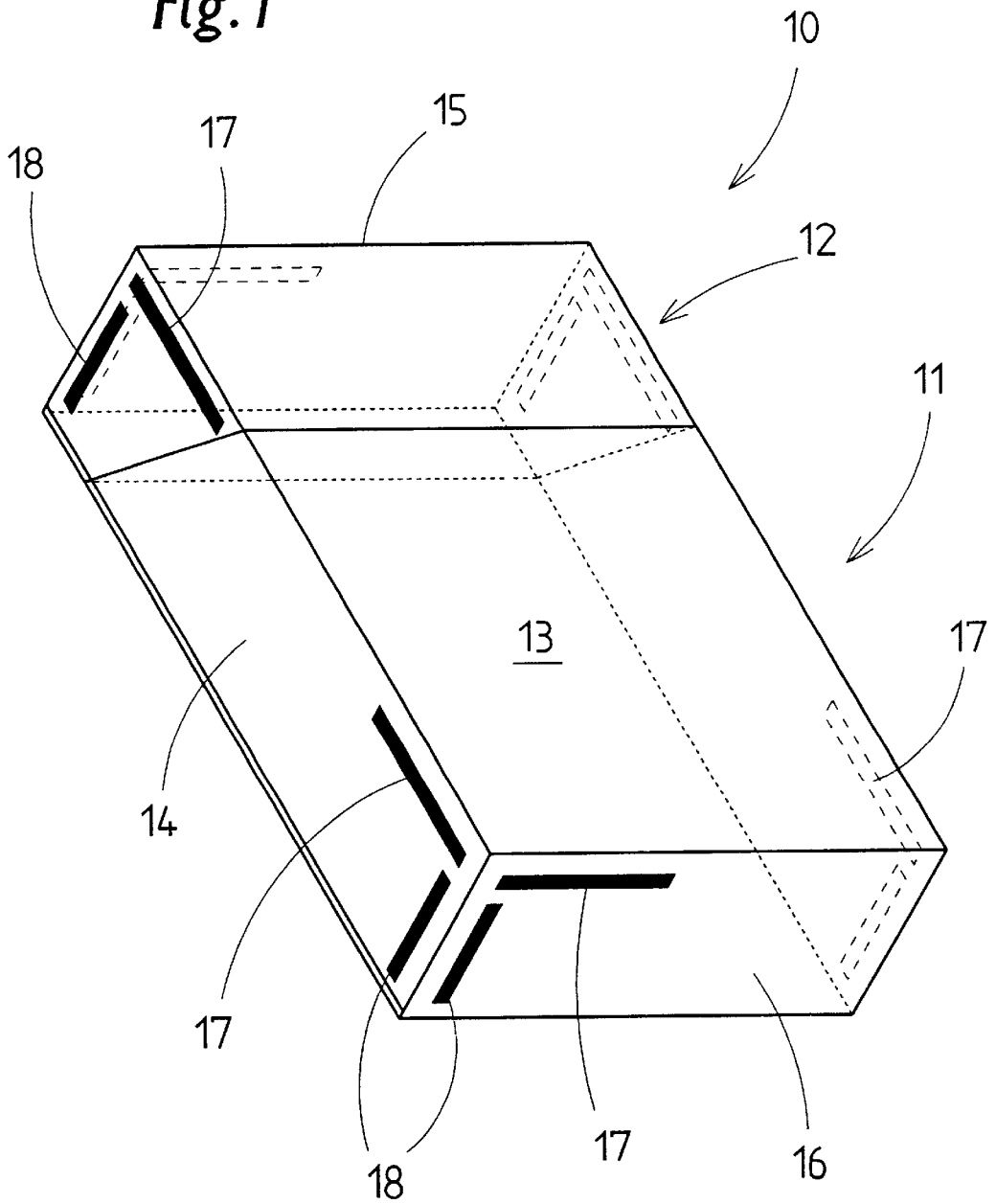
FIG. 1 a perspective illustration of a cigarette pack of the hinge-lid-box type, FIG. 2 a schematic side view of a sub-region of a packaging machine, FIG. 3 on an enlarged scale, the apparatus according to FIG. 2 in a transverse view, FIG. 4 a schematic side view of another region of the packaging machine or of another exemplary embodiment of the same, FIG. 5 an axial side view of a turret for conveying packs, namely a drying turret, FIG. 6 an axis-perpendicular side view of the turret according to FIG. 5, FIG. 7 on an enlarged scale, a detail of the folding turret in a side view corresponding to FIG. 5, FIG. 8 a detail of a folding turret analogous to FIG. 5 in a plan view of a pocket, and FIG. 9 the detail according to FIG. 8 with an element in a different position, FIG. 10 a packaging machine in schematic plan view with a device for printing packs.

FIG. 1 shows the most important application example for the coding of packs 10, namely a cigarette pack of the hinge-lid-box type. The latter comprises, as is known, a box part 11 and a lid 12. The pack 10 is of cuboidal configuration with a large-surface-area front side 13, narrow, upright side surfaces 14 and even smaller end surfaces, namely a top surface 15 and base surface 16.

The pack 10 is intended to be provided with outer printing, to be precise in particular with a coding, e.g. comprising numbers, letters and/or strokes. The coding is provided by means of a laser. For this purpose, selected outer surfaces of the pack 10 are provided with coding surfaces 17, 18. These are strip-like, outer coatings of the packs 10 which, during printing or coding, are partially removed by the laser, the letters, numbers or strokes being formed in the process. The illustration in FIG. 1 shows a number of alternatives for providing the coding surfaces 17, 18. The mutually opposite narrow, upright side surfaces 14, to be precise in the region adjacent to the base surface 16 and/or in the region of the lid 12 adjacent to the top surface 15, are preferred. Alternatively or additionally, corresponding coding surfaces 17, 18 may be arranged in the region of the top surface 15 and base surface 16, to be precise in each case adjacent to a neighboring surface, that is to say adjacent and parallel to a pack edge.

A number of advantageous solutions are presented for providing the coding in the region of the coding surfaces 17 or 18. In all cases, the packs 10 have already been completed and, if appropriate, are still to be provided with an outer sheet-material wrapping.

Figure 2:
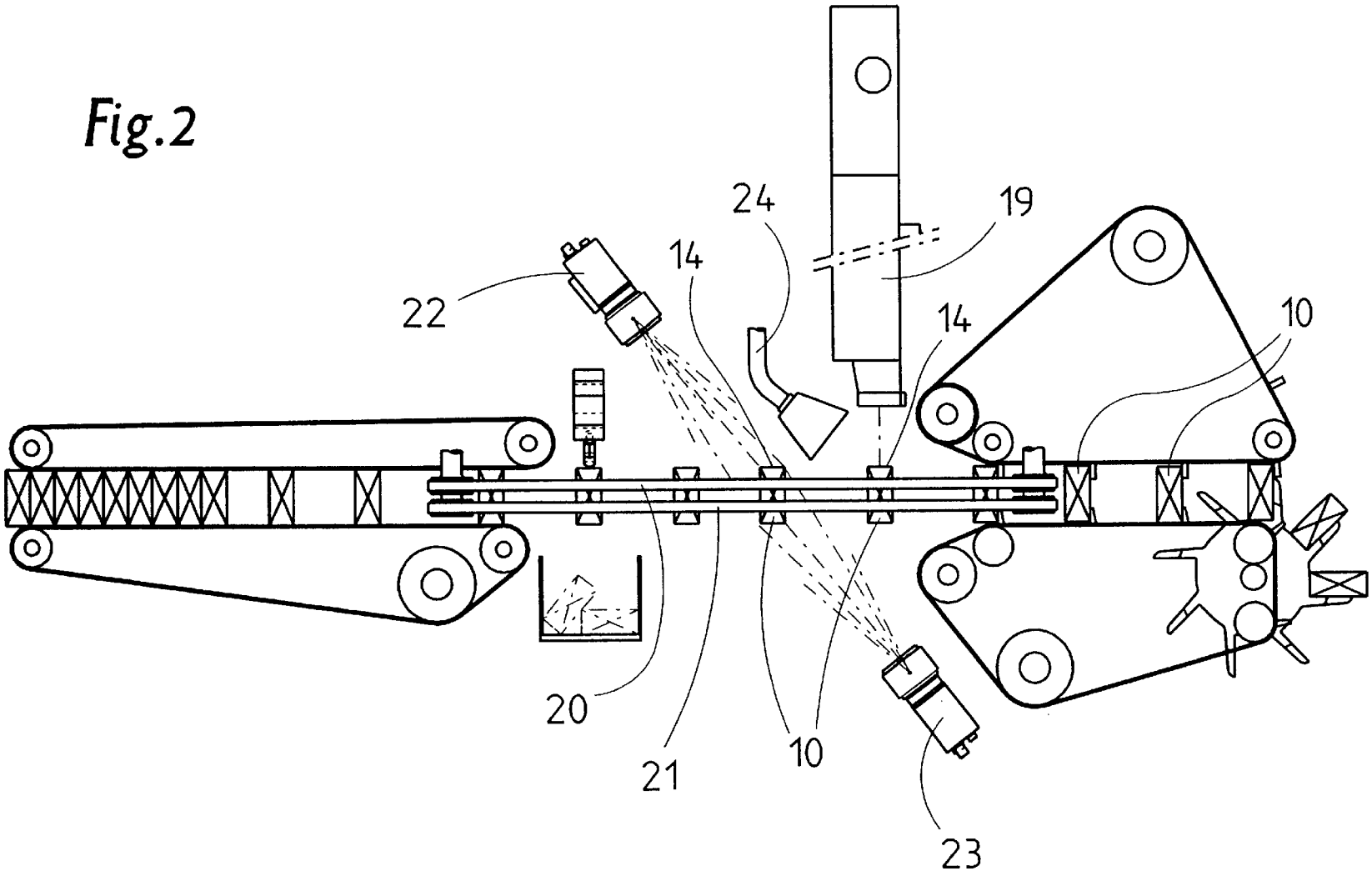

In the exemplary embodiment according to FIG. 2, a printing subassembly or a laser coder 19 is positioned in the region of a conveying section for the packs. The packs 10 are transported here such that the top surface 15 and base surface 16 are directed sideways and one of the side surfaces 14 is oriented upwards. The packs 10 are conveyed at a distance apart from one another, to be precise by endless conveyors which act in the region of the sideways directed surfaces. Said endless conveyors are two (flat) belts 20, 21 which are spaced apart from one another heightwise. The upwardly directed pack surface, that is to say the side surface 14, is fully exposed. Accordingly, the laser coder 19 can provide the coding surfaces 17, 18 arranged in the region of the side surface 14 with a coding during the transportation of the packs 10 or during a temporary standstill of the same.

The apparatus according to FIG. 2 is part of a packaging machine, and specifically serves primarily for checking the packs 10 for the correct configuration. The belts 20, 21 form a checking section, in the region of which checking elements, namely cameras 22, 23 are arranged. Said cameras scan the outer appearance of the pack 10 and check the correct form of the same, in the present case also with respect to the coding. Accordingly, the laser coder 19 is arranged upstream of the checking station and/or upstream of the cameras 22, 23, as seen in the conveying direction of the packs 10, with the result that said cameras can also check the correct coding. Otherwise, the checking apparatus is expediently designed in accordance with EP 854 090. For eliminating any possible material particles in the region of the coding, a suction element 24 is provided in this exemplary embodiment, said suction element being connected to a negative-pressure source during the coding of a pack 10.

Figure 3:
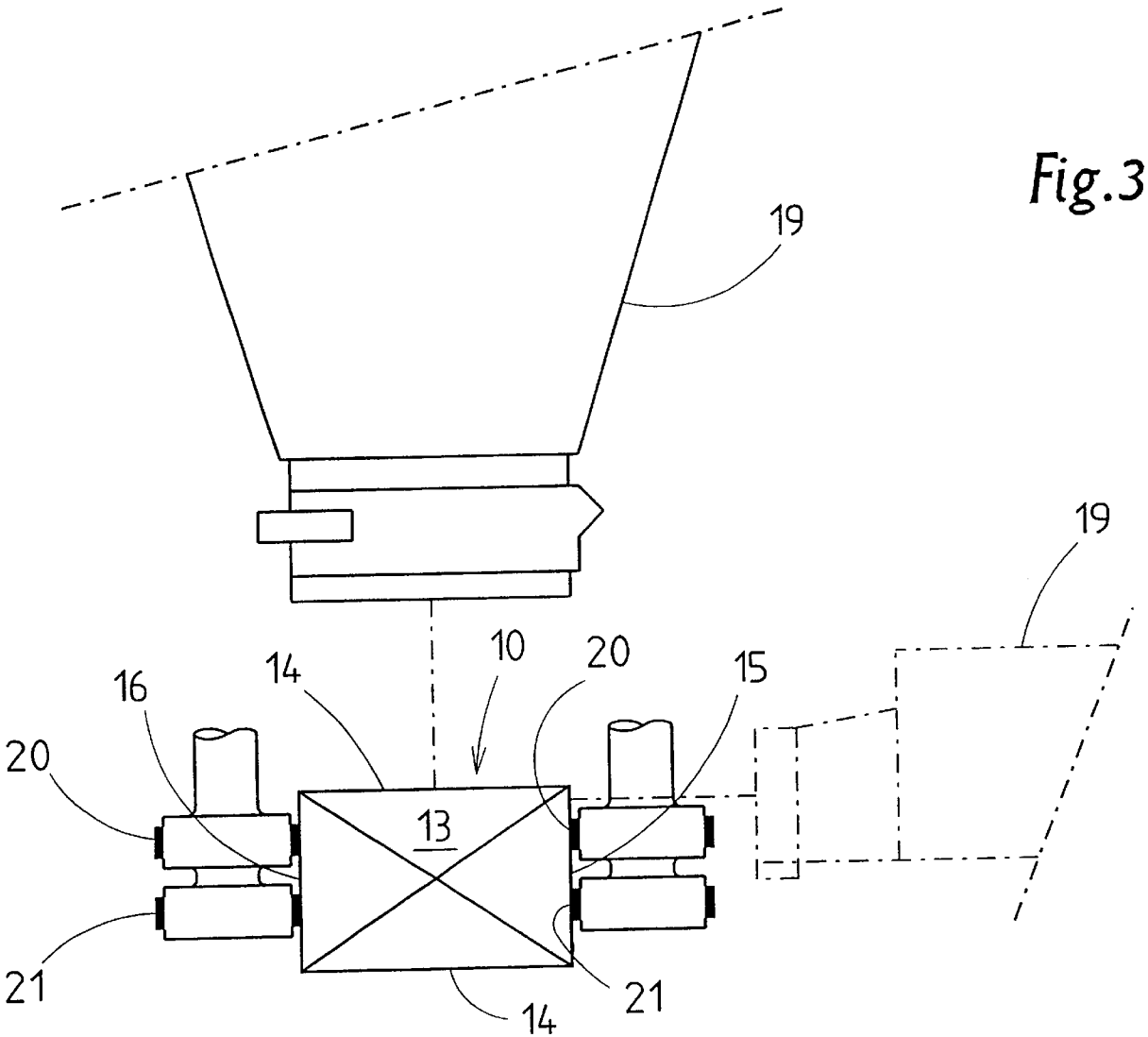

As can be seen from FIG. 3, it is also possible to provide a printing subassembly or a laser coder 19 in an apparatus according to FIG. 2 in the region of the belts 20, 21 such that sideways directed surfaces of the pack 10, that is to say the top surface 15 or base surface 16, may be provided with a coding. The laser coder 19 is positioned laterally along the movement path of the packs 10 in accordance with the dash-dotted illustration. In this case, a laser beam is directed onto a free region of the top surface 15 or base surface 16, in the present case above the top belt 20.

Figure 4:
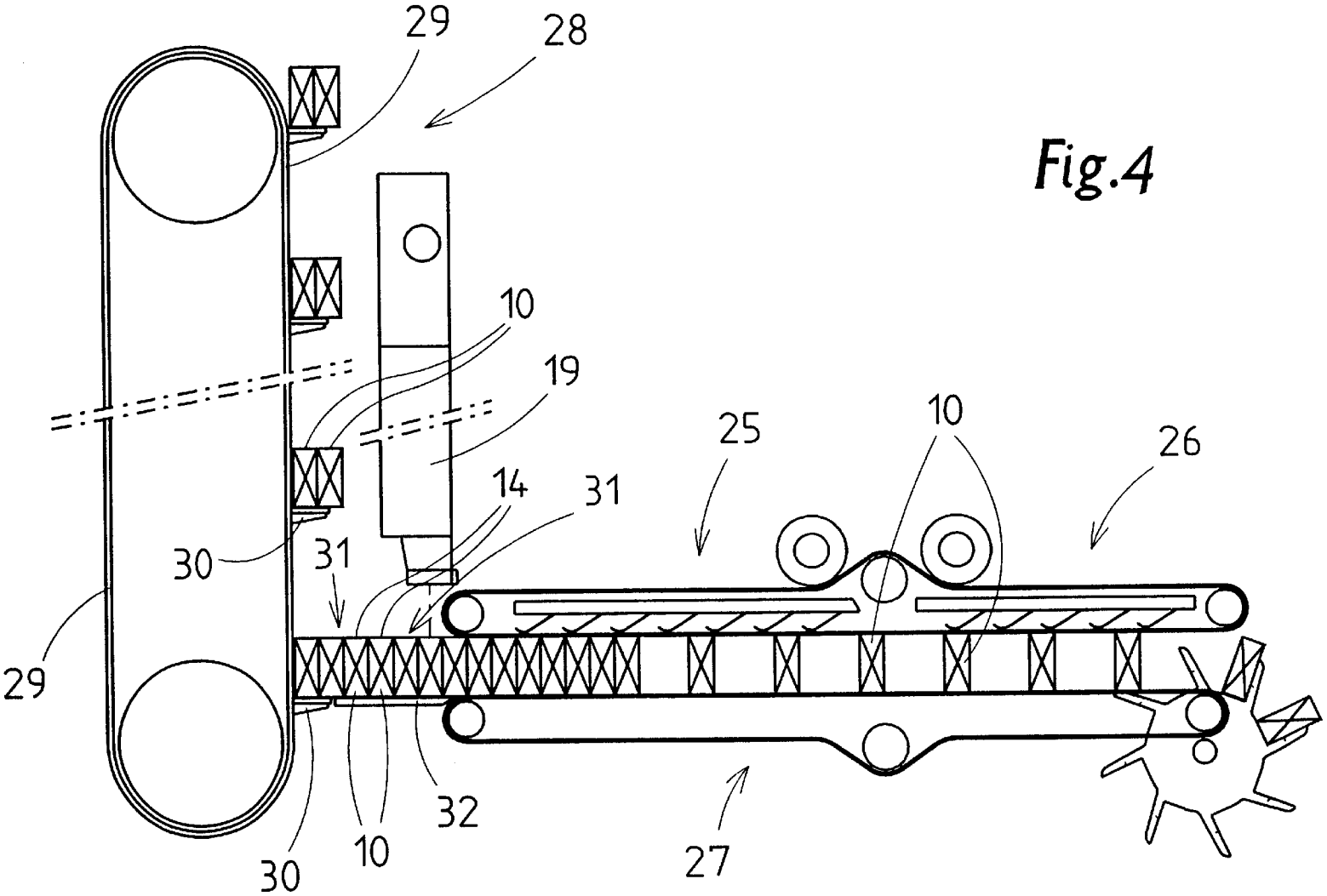

The apparatus according to FIG. 4 is likewise located in the end region of a packaging machine. This is a collecting and conveying apparatus for packs 10 largely corresponding to EP 596 387.

The packs 10 are transported at a distance apart from one another by a horizontal pack conveyor 25. The latter comprises a top conveying belt 26 and a bottom conveying belt 27. The packs 10 are gripped in each case by a top strand and a bottom strand in the region of upwardly and downwardly oriented pack surfaces, to be precise in the region of the correspondingly positioned side surfaces 14.

The intention is for the packs to be transferred to a vertical conveyor 28. The latter is designed such that transversely projecting platforms 30 are spaced apart from one another on an upright endless conveyor 29. Said platforms each grip a plurality of, namely two, packs 10 and transport these upwards.

In the case of this apparatus, the pack conveyor 25 terminates at a distance from the vertical conveyor 28. The packs 10 are formed here into a closely packed row 31. This is sent to the vertical conveyor 28, via a bridge plate 32, by respectively following packs 10. In the region of this final conveying section, namely the bridge plate 32, the top side of the packs 10 is free, with the result that the upwardly directed pack surface—side surface 14—may be provided with the coding by a laser coder 19 positioned above the packs 10 such that it follows the pack conveyor 25. Additionally or alternatively, it is also possible, in this apparatus, for a laser coder to be positioned sideways alongside the pack conveyor 25, if the sideways directed free pack surfaces, namely the top surface 15 or base surface 16, are to be provided with a coding.

Figure 5:
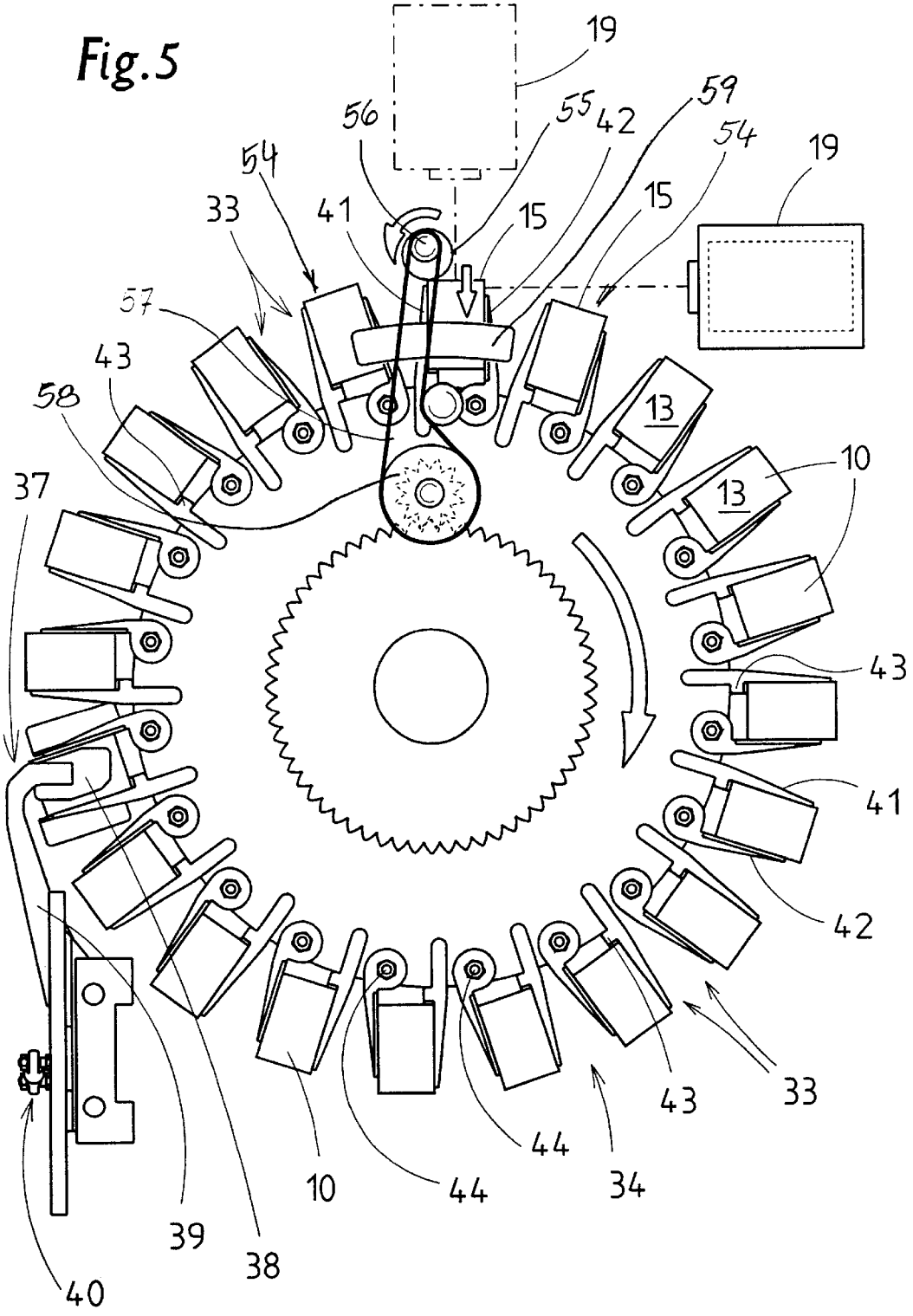
Figure 6:
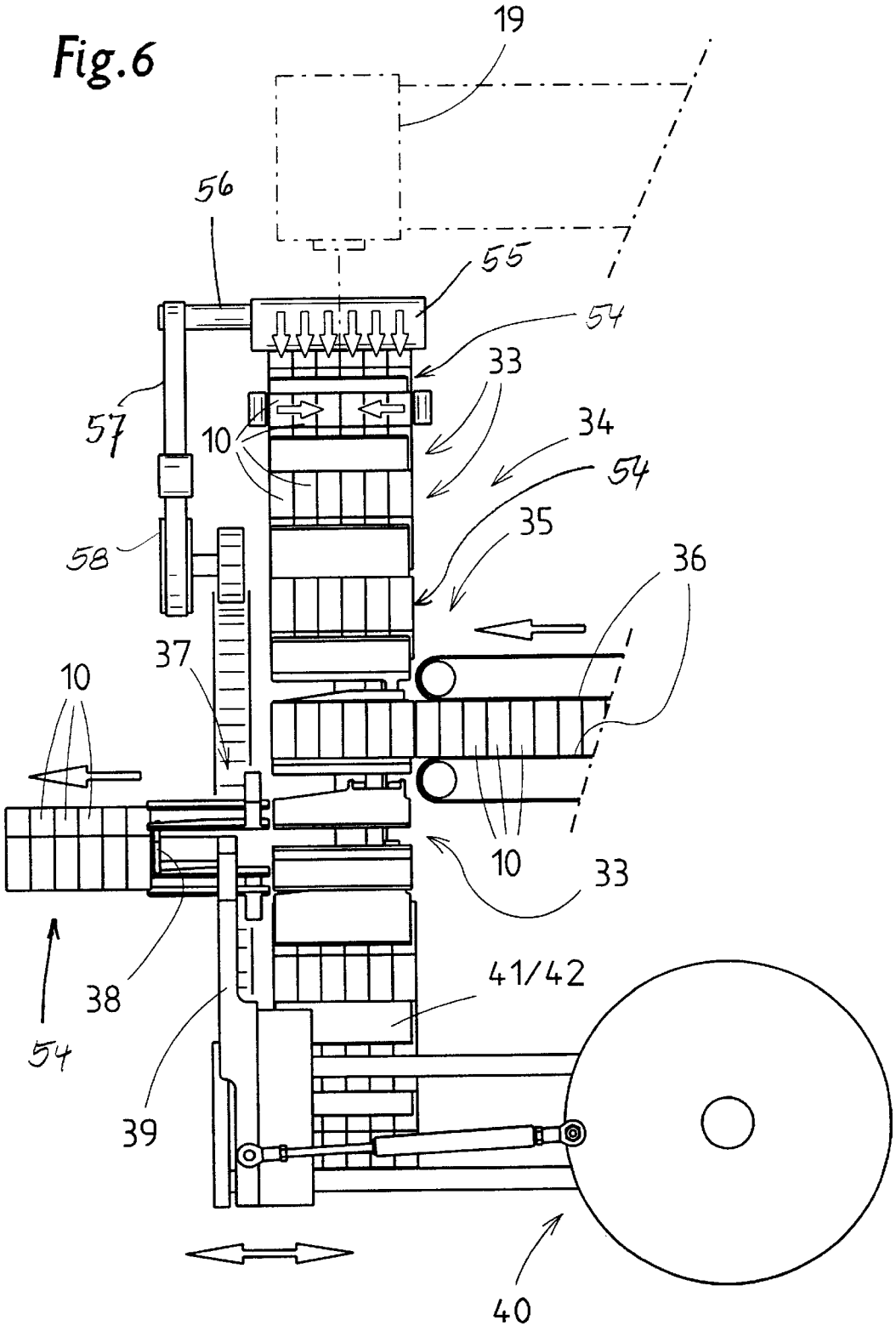

An important exemplary embodiment is shown in FIG. 5 and FIG. 6. The packs 10 are transported as a pack group in pockets 33 of a turret 34. This is a drying turret designed in the approximate embodiment pursuant to U.S. Pat. No. 4,636,186. The task of the turret 34 is to transport the packs 10 or pack groups 54 for a certain period of time in order that glued positions of the packs can set while the correct form is maintained.

The pockets 33 are designed such that the packs 10 of a pack group 54, namely, in the present case, six packs 10 as pack group 54, are arranged one beside the other in the axial direction. The pockets 33 are open on both axial sides, with the result that, in the region of a charging station 35, the packs 10 can be introduced into a respectively free pocket 33 by a feed conveyor 36 in the axis-parallel direction. A push-out station 37 is formed in a position which is offset in the circumferential direction and, in said push-out station, at the same time as the charging operation, a pack group 54 is pushed out of a pocket 33, likewise in the axis-parallel direction. For this purpose, use is made of a slide 38 which can be moved back and forth in the corresponding direction and is connected, via a carrying arm 39, to an actuating mechanism, namely to a crank 40.

The pockets 33 are of specific design, that is to say they comprise essentially two lateral pocket walls 41, 42. These grip the packs 10 in the region of the side surfaces 14. The top surfaces 15 or base surfaces 16 are directed radially inwards or outwards. One of the pocket walls, namely the pocket wall 41, is arranged in a fixed manner and forms, with a radially inner leg 43, an inner boundary of the pocket 33 for the packs 10. The other, opposite pocket wall 42 can be pivoted about an inner bearing 44. Accordingly, by virtue of the pocket wall 42 being pivoted, the pocket 33 can easily be opened in order to allow the packs 10 to be pushed in and out in a disruption-free manner.

The (drying) turret 34 is particularly advantageous as a conveyor for the packs in the region of a printing unit or laser. The outwardly-directed pack surfaces, namely top surfaces 15, can directly face a laser coder 19 (dash-dotted in FIG. 5), with the laser coder 19 being expediently positioned in a vertical center plane of the turret 34 above same. The pack group 54 facing the laser coder 19 is provided with the printing or coding in a single working stroke, with the laser beam being appropriately guided by means of displaceable mirrors. Alternatively, it is also possible to arrange a plurality of, in particular two, laser coders side by side in the axial direction, with each of these laser coders processing a number of packs 10 of the pack group 54.

Another alternative is likewise shown in FIG. 5 and FIG. 6. A pocket wall, namely in the present case the rear pocket wall 42, as seen in the direction of rotation, is formed with a smaller radial dimension than that of the packs 10. A radially outer region of the associated side surface 14 projects beyond the pocket wall 42. In the corresponding, top station, the laser coder 19 may thus provide the coding on the free region of the side surface 14 with a horizontal laser beam.

A special feature is that the packs 10 of a pack group 54 are precisely aligned during the coding at least in the region of the surfaces to be printed. FIG. 5 and FIG. 6 show this alignment in principle on the basis of the outwardly-directed top surfaces 15. A displaceable pressure-exerting element extends across all packs 10 of the pack group 54. During (laser) printing, the end surfaces are thus exactly positioned in a common plane.

The pressure-exerting element is a stationary, rotatable pressure roller 55. It extends in the axis-parallel direction across the full length of the pack group 54 or beyond it (FIG. 6). In the position of alignment, the pressure roller 55 lies offset to the center plane of the surfaces or top surfaces 15 such that laser coding can be made on an adjacent exposed area.

The pressure roller 55 is arranged and movable to the extent that its pressure-exerting and alignment effect takes place only during the coding phase. For this reason, the pressure roller 55 here is configured as an eccentric or mounted on an off-centered shaft journal 56. The latter is rotatably driven, specifically by means of a drive belt or toothed belt 57, which in turn is driven by a wheel gear 58. The wheel gear 58 is driven by the turret 34 via a centrical toothed wheel and a pinion gear, with the result that the pressure roller 55 executes its movement in exact agreement with the rotational movement of the turret 34. As a pocket 33 with pack group 54 moves into the coding position, the circumferential surface of the pressure roller 55 assumes a retracted position. The eccentric shaft 56 is situated in a manner that ensures that in the coding position according to FIG. 5, the pressure-exerting and alignment force is transferred to the pack group 54.

In order to align the packs 10 of a pack group 54 additionally or alternatively in the region of other exposed surfaces, namely in the region of the front sides 13, stationary guide tracks 59 are positioned at either side of the pockets 33 which act on the facing front sides 13 of the pack group 54 in the sense of an exact alignment of the entire pack group 54.

Figure 7:
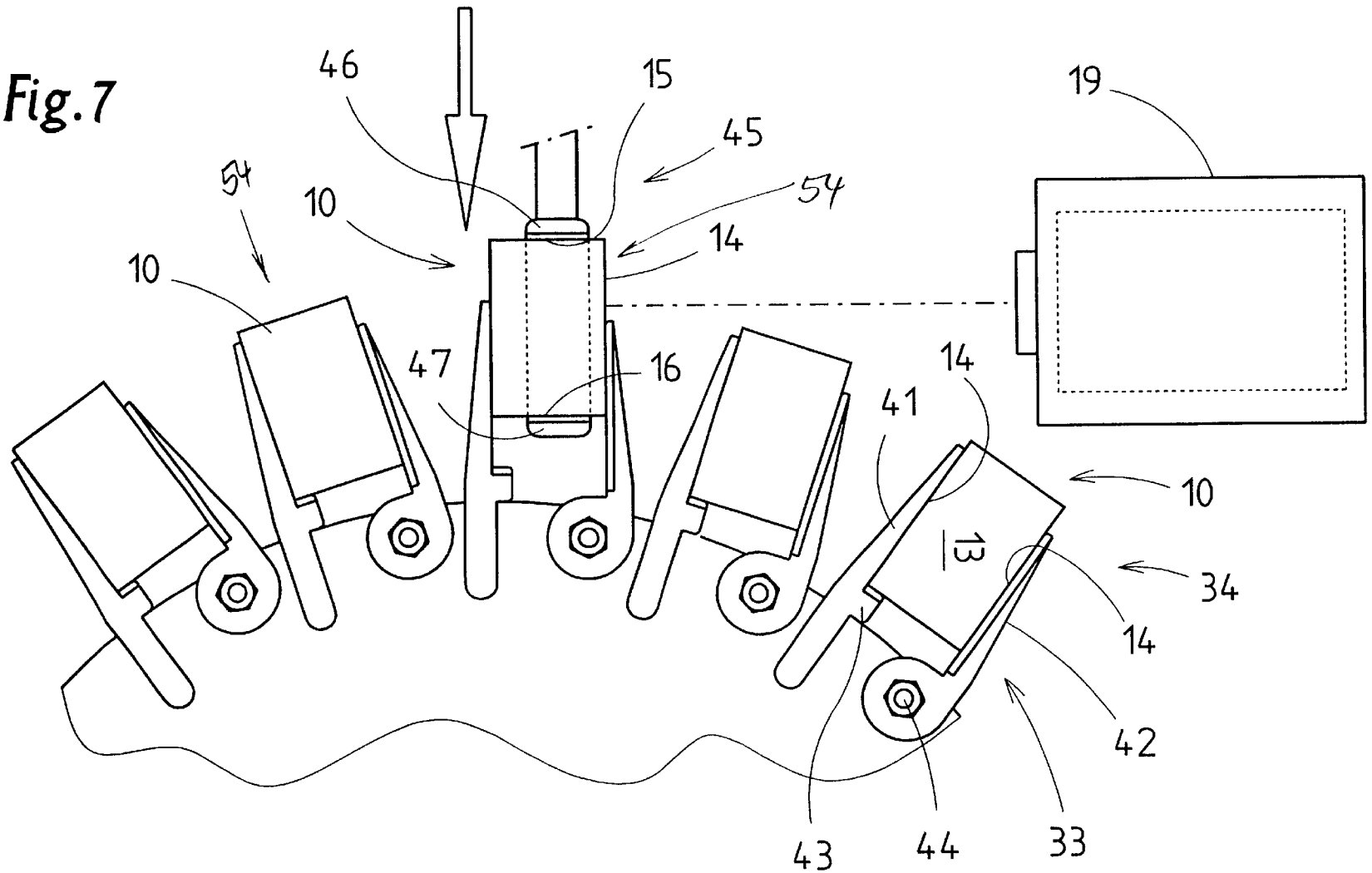

In the exemplary embodiment according to FIG. 7, a (drying) turret 34 also serves to transport the packs 10 or pack groups 54. For executing the coding with the help of a laser coder 19, the packs 10 or pack group 54 are partially and temporarily moved out of the position within the pocket 33 into the coding position. In this position the surfaces or surface areas of the packs 10 to be provided with printing are exposed. In the exemplary embodiment of FIG. 7, the packs 10 are positioned or movable in such a manner that the upwards or laterally directed side surfaces 14 are partially exposed and can be impacted by the laser coder. The latter, as shown in FIG. 7, can be positioned vertically above the packs to be coded. The arrangement according to FIG. 7, however, can be applied in like manner to a horizontal arrangement or direction of action of the laser coder 19.

Employed for the movement of the packs 10 or pack groups 54 is a fork-like slide 45, preferably for each pocket 33. The slide 45 has two legs 46, 47 which are connected to one another and are spaced apart from one another by a distance corresponding essentially to the length or other dimension of the pack 10. The slide 45 is advanced up to the pocket 33 by movement in the radial direction and in the axis-parallel direction such that the group of packs 10 within the pocket 33, is gripped by the legs 46, 47 in the region of the inner and outer surfaces, namely of the top surface 15 and base surface 16. By radially directed movement, the packs 10 are then moved out of the pocket 33 into the position shown in FIG. 7. Once the printing has been carried out, the packs 10 are guided back into the pocket 33 by the slide 45 being moved in the corresponding opposite direction.

Figure 9:
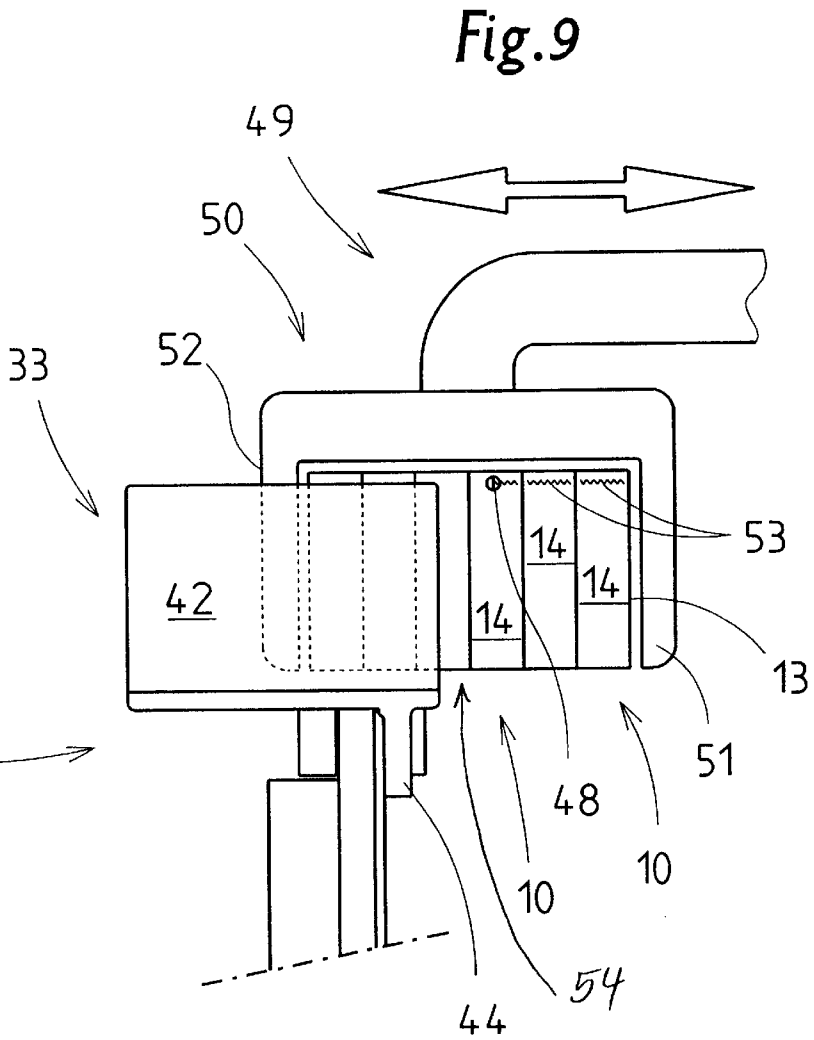
Figure 8:
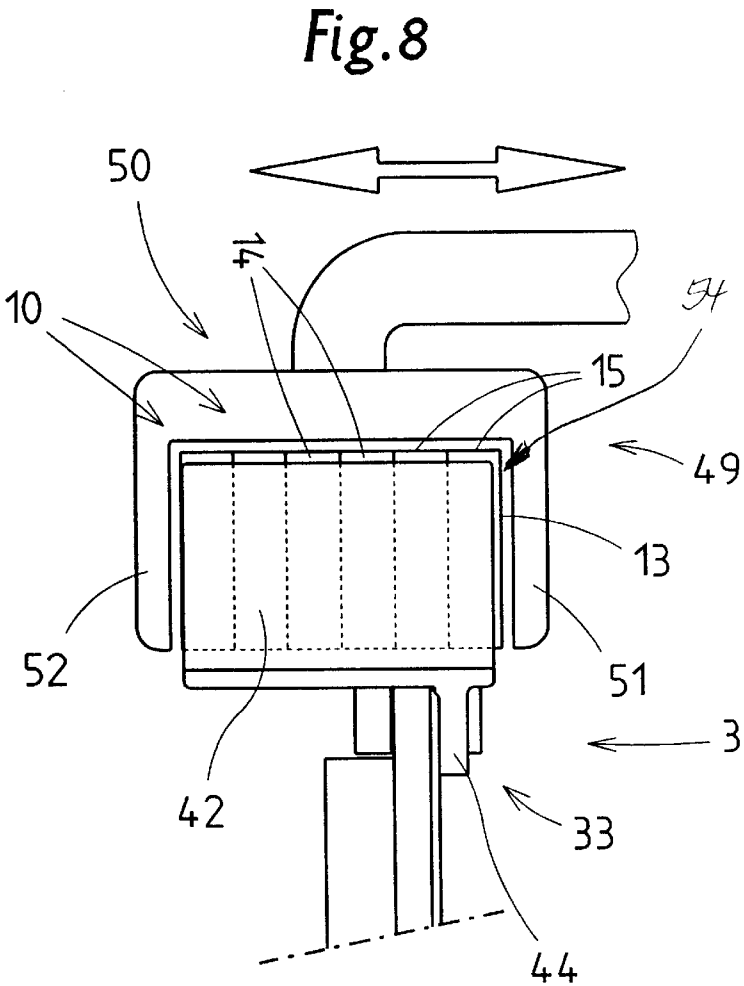

The principle outlined above is realized in a specific manner according to FIGS. 8 and 9. The packs 10 which are to be coded are moved wholly or partially out of the pocket 33 such that, during this movement, they are moved one after the other past a laser coder, of which a (movable) laser beam 48 is illustrated schematically in FIG. 9.

As a conveying element for the packs 10, a slide 49 which has a fork-like head 50 is assigned to the relevant pocket 33. Two spaced-apart legs 51, 52 grip the packs 10, or the group of packs, in the region of pack surfaces which are exposed on both sides in the radial direction of the turret 34, namely on the front side 13 and the opposite side. The packs 10 are moved sideways out of the pocket 33 in the axis-parallel direction by the slide 49. In this case, the corresponding relative movement of the slide 49 causes the in particular upwardly directed side surfaces 14 to be subjected one after the other to the action of the laser coder or of the laser beam 48, with the result that the latter can provide a coding 53 at the desired location of the pack 10. Following the coding of all the packs 10 by corresponding movement of the slide 49, the latter returns with the packs 10 into the starting position (FIG. 8). The turret 34 is then moved on by one position.

Figure 10:
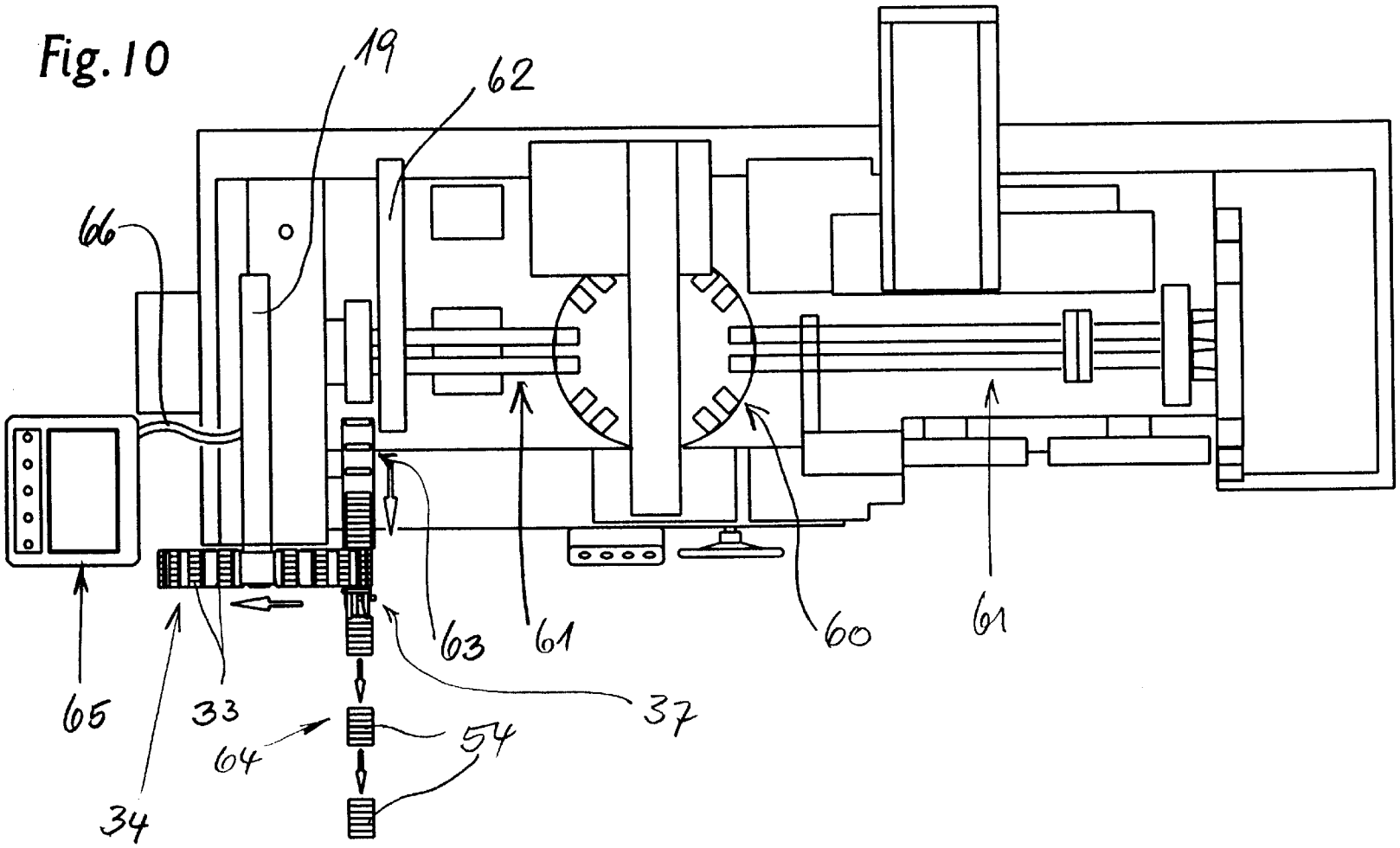

FIG. 10 shows a special solution for the integrated printing and coding of packs 10 in a packaging machine for the production of packs 10 of the hinge-lid type. The packaging machine is set to a two-web mode of operation. The packs coming from a folding turret 60 are transported along a pack path 61 running approximately centered within the packaging machine and fed to a first drying turret 62 of known construction. From here the packs are transferred by a pack conveyor 63 to a second drying turret, namely to turret 34. The packs 10 are transported by the pack conveyor 63 in the axis-parallel direction in a side region of the turret 34 and discharged in the same direction by a discharge conveyor 64.

Of particular importance is the positioning of the turret 34 in a longitudinal plane at the front side of the packaging machine. This arrangement provides space at the rear for positioning the laser coder 19. The latter usually comprises an elongated housing which here is positioned at the rear side of the turret 34. Located next to the laser coder 19 is a control device 65 used for the input of the coding to be printed and which is connected to the laser coder 19 via a control line 66. The control device 65 is also located at the end or at the edge of the packaging machine in a functionally favorable position.

| List of designations | |
|---|---|
| 10 | pack |
| 11 | box part |
| 12 | lid |
| 13 | front side |
| 14 | side surface |
| 15 | top surface |
| 16 | base surface |
| 17 | coding surface |
| 18 | coding surface |
| 19 | laser coder |
| 20 | belt |
| 21 | belt |
| 22 | camera |
| 23 | camera |
| 24 | suction element |
| 25 | pack conveyor |
| 26 | conveying belt |
| 27 | conveying belt |
| 28 | vertical conveyor |
| 29 | endless conveyor |
| 30 | platform |
| 31 | closely packed row |
| 32 | bridge plate |
| 33 | pocket |
| 34 | turret |
| 35 | charging station |
| 36 | feed conveyor |
| 37 | push-out station |
| 38 | slide |
| 39 | carrying arm |
| 40 | crank |
| 41 | pocket wall |
| 42 | pocket wall |
| 43 | leg |
| 44 | bearing |
| 45 | slide |

-continued

| List of designations | |
|---|---|
| 46 | leg |
| 47 | leg |
| 48 | laser beam |
| 49 | slide |
| 50 | head |
| 51 | leg |
| 52 | leg |
| 53 | coding |
| 54 | pack group |
| 55 | pressure roller |
| 56 | shaft journal |
| 57 | toothed belt |
| 58 | wheel gear |
| 59 | guide track |
| 60 | folding turret |
| 61 | pack path |
| 62 | drying turret |
| 63 | pack conveyor |
| 64 | discharge conveyor |
| 65 | control device |
| 66 | control line |

What is claimed is:

1. A process for providing printing or coding on free outer surfaces of packs (10) by means of a printing unit or a laser coder (19), the printing unit or laser coder (19) being positioned in a stationary manner alongside an endless conveyor which conveys the packs (10), said process comprising the steps of:

moving the packs (10) past the printing unit or coder (19) so that an outer surface of each pack (10) is directed towards the printing unit or laser coder (19) and is not covered by the endless conveyor;

for the purpose of printing or coding, the packs (10) moving the packs out of conveying elements of the endless conveyor such that the outer surfaces of the packs (10) which are to be provided with a coding or printing are exposed; and once the printing or coding has been carried out, moving the packs (10) into the conveying elements.

2. An apparatus for providing printing or coding on free outer surfaces of packs (10) by a printing unit or a laser coder (19), said apparatus comprising:

a pack conveyor which conveys the packs (10) past the printing unit or laser coder (19);

means for retaining the packs (10) on the pack conveyor so that the pack surfaces which are to be provided with the printing or coding are at least partially exposed so that the exposed pack surfaces for receiving the printing or coding, are directed towards the printing unit or laser coder 19;

wherein said pack conveyor comprises a rotating turret (34) with pockets (33) for retaining the packs, wherein the printing unit or the laser coder (19) has a stationary position adjacent to an outer side of the rotating turret (34) and prints or codes the exposed pack surfaces; and means for, during the printing or coding, moving the packs (10) out of a conveying position into a position suitable for the printing or coding relative to the printing unit or laser coder (19), and for, after completion of the printing or coding, moving the packs back into the conveying position.

3. The apparatus according to claim 2, wherein the means for moving comprises a slide (45, 49) which moves the packs (10) wholly or partially out of a pocket (33) of the turret (34) such that a pack surface (14) moves into an active position relative to the printing unit or laser coder (19).

4. Apparatus according to claim 3, wherein the slide (45, 49) has two spaced-apart legs (46, 47; 51, 52) which grip the packs (10) on opposite sides such that, by radial or axis-parallel movement of the slide (45, 49) relative to an axis of rotation of the turret, the packs (10) are moved out of the pocket (33).

5. The apparatus according to claim 2, wherein the conveyor provides relative movement of the packs (10) past the printing unit or laser coder (19) so that said printing unit or laser coder (19) provides the printing or coding (53) on the packs one after the other during the relative movement.

6. A process for providing markings or printing on exposed outer surfaces of cigarette packs (10) by means of a printing unit (19), said process comprising the steps of:

conveying the cigarette packs (10) past the printing unit (19);

positioning the printing unit in a stationary manner alongside an endless conveyor having two spaced-apart conveying elements for conveying the cigarette packs (10);

positioning the cigarette packs (10) such that opposing first and second outer surfaces thereof abut the two conveying elements (20; 21); and marking or printing at least a third one (14) of the outer surfaces (10) which is not abutting the conveying elements (20, 21) of the endless conveyor.

7. The process according to claim 6, wherein said third surface is a larger side surface (14) of the packs.

8. The process according to claim 6, further comprising the step of providing the markings or printing while moving the cigarette packs (10) through a checking unit which captures an image of an external appearance of the cigarette packs.

9. A process for providing markings or printing to free outer surfaces of cigarette packs (10) by means of a printing unit (19), comprising the steps of:

a) moving the cigarette packs (10) by a horizontal endless conveyor (25) to a vertical conveyor (28);

b) in a region between the horizontal endless conveyor (25) and the vertical conveyor, positioning one (14) of the outer surfaces to lie on a bridge plate (32); and c) printing or marking, with a stationary printing unit, an opposite exposed one of the outer surfaces (14) of the cigarette packs (10).

10. The process according to claim 9, comprising the steps of:

positioning the one exposed outer surface (14) to face upward; and disposing the printing unit (19) above the bridge plate (32).

11. A process for providing markings or printing to exposed outer surfaces of cigarette packs (10) by means of a printing unit (19), comprising the steps of:

arranging the cigarette packs (10) in pockets of a rotary circular turret (34); and printing, with the stationary printing unit (19), the markings or printing on only ones of the exposed outer surfaces which point in a radially outward direction from the turret.

12. The process according to claim 11, further comprising carrying out the printing step during a standstill phase of the turret (34).

13. The process according to claims 12, further comprising the steps of:

causing the turret to rotate about a horizontal axis; and printing on only those cigarette packs (10) which are disposed in a vertical direction during the standstill phase of the turret (34).

14. The process according to claim 13, wherein only top surfaces (15) of the cigarette packs (10) are marked or printed.

15. The process according to claim 6, further comprising the steps of:

conveying the cigarette packs (10) as a pack group (54) such that at least one pack surface (15) of all cigarette packs (10) of the pack group (54) is exposed;

simultaneously providing the pack group (54) with the markings or printing, in a region of a coding station, by means of one or more laser coders (19); and during the marking or printing step, precisely aligning the cigarette packs (10) of the pack group (54) with respect to the surfaces to be marked or printed.

16. The process according to claim 6, further comprising the steps of:

for the marking or printing step, moving the cigarette packs (10), in a region of the printing unit (19), out of the conveying elements in such a manner that the outer surfaces to be provided with markings or printing are exposed; and upon completion of the marking or printing step, moving the cigarette packs (10) into the conveying elements.

17. An apparatus for providing markings or printing on exposed outer surfaces of cigarette packs (10), comprising:

a printing unit (19); and a conveyor which moves the cigarette packs (10) past the printing unit (19), said conveyor having at least two conveying elements (20, 21) which are spaced at a distance from one another, and which hold the packs, wherein the printing unit (19) is disposed laterally adjacent to the conveying elements (20, 21), so that at least one of the outer surfaces which does not abut the conveying elements (20, 21) is marked or printed by the printing unit.

18. The apparatus according to claim 17, further comprising a checking device or checking path, wherein the printing unit (19) is disposed above a path of movement of the cigarette packs (10) in a region of said checking device or checking path.

19. An apparatus for providing markings or printing, on exposed outer surfaces of cigarette packs (10), comprising:

a printing unit (19);

a conveyor which moves the cigarette packs (10) downstream past the printing unit so that the cigarette packs (10) can be marked or printed by the printing unit (19) in a region of a tightly-packed row (31) of packs; and an upstream pack conveyor (28) which ends before an operating region of the printing unit (19), and which forms the tightly packed rows.

20. An apparatus for providing markings or printing on exposed outer surfaces of cigarette packs (10), comprising:

a printing unit (19);

a rotary circular turret (34) with radially directed pockets (32) for retaining the cigarette packs; and which moves the cigarette packs (10) past the printing unit, said turret feeding the cigarette packs in the pockets to the printing unit (19);

the printing unit (19) being positioned in a stationary manner, adjacent to an outer side (35) of the rotary turret (34), and printing the markings or printing on the exposed pack surfaces during a standstill phase of the turret (34).

21. The apparatus according to claim 20, wherein the rotary turret (34) is a drying turret whose pockets (33) are adapted to receive a pack group (54) consisting of a plurality of cigarette packs (10), arranged adjacent to one another in axis-parallel orientation relative to a rotational axis of the turret, said printing unit being positioned to print on a radially outwardly directed pack surface (15) during the standstill phase of the turret (34).

22. The apparatus according to claim 20, wherein the printing unit is a laser coder (19), and wherein the radially directed pocket walls (41, 42) of the turret are dimensioned such that an area of a pack surface (14), facing the pocket walls (41, 42), projects from a pocket (33) in the radial direction of the rotary turret, and such that the laser coder (19), oriented in a transverse direction relative to a rotational axis of the turret, prints a coding on the area.

23. The apparatus according to claim 20, further comprising a pressure-exerting device (35), in a region of a coding station, precisely aligning the packs and abutting the pack surfaces (15).

24. The apparatus according to claim 22, further comprising, for the printing or laser coding of the cigarette packs (10) arranged in a pack group (54), a plurality of laser coders (19) positioned next to each other, each laser coder (19) impinging a plurality of cigarette packs (10) of the pack group (54) during a standstill phase of the turret (34).

25. The apparatus according to claim 22, further comprising means for moving the cigarette packs (10) to be printed or coded out of a conveying position to an appropriate printing or coding position relative to a printing unit or laser coder (19), and means for moving the cigarettes packs (10) back to the conveying position after the printing or coding has been executed.

26. The apparatus according to claim 24, further comprising a slide (45, 49) which moves the packs completely or partially out of a pocket (33) of the turret (34), so that a pack surface is in an effective coding position relative to the laser coder (19).

27. The apparatus according to claim 26, wherein the slide (45, 49) has two legs (46, 47; 51, 52) which are disposed at a distance from one another and which grip the cigarette packs (10), or a group of cigarette packs (10), at opposite sides thereof so that the cigarette packs (10) can be moved from the pocket (33) by a radial or axis-parallel movement of the slide (45, 49).

28. The apparatus according to claim 24, further comprising means for moving the cigarette packs (10) past the laser coder (19) through a movement relative to the turret (34), the laser coder (19) applying the coding to the cigarette packs (10) in succession during said relative movement.

* * * * *